US009765535B2

(12) United States Patent
Montgomery

(10) Patent No.: US 9,765,535 B2
(45) Date of Patent: Sep. 19, 2017

(54) UTILITY PUTTY KNIFE WITH RETRACTABLE TOOL

(71) Applicant: Matthew Montgomery, Lexington, SC (US)

(72) Inventor: Matthew Montgomery, Lexington, SC (US)

( * ) Notice: Subject to any disclaimer, the term of this patent is extended or adjusted under 35 U.S.C. 154(b) by 0 days.

(21) Appl. No.: 14/794,114

(22) Filed: Jul. 8, 2015

(65) Prior Publication Data

US 2017/0009466 A1 Jan. 12, 2017

(51) Int. Cl.
*E04F 21/32* (2006.01)
*B26B 11/00* (2006.01)

(52) U.S. Cl.
CPC ..... *E04F 21/32* (2013.01); *B26B 11/006* (2013.01)

(58) Field of Classification Search
CPC ..... B26B 11/00; B26B 11/001; B26B 11/006; E04F 21/32
USPC ..... 30/151–162, 169, 172; D8/45, 107; D32/46, 49
See application file for complete search history.

(56) References Cited

U.S. PATENT DOCUMENTS 471,562 A * 3/1892 Minnerly ..... B67B 7/24 30/152
699,207 A * 5/1902 Moe ..... B44D 3/162 30/169
825,063 A 7/1906 Lawbaugh
832,455 A * 10/1906 Christensen ..... B44D 3/162 7/158
960,624 A 6/1910 Comptom
1,015,026 A * 1/1912 Jackson et al. ..... B25F 1/04 30/152
1,552,361 A * 9/1925 Trombley ..... B25F 1/00 30/161
1,597,464 A 8/1926 Hebner
1,598,420 A * 8/1926 Brossett ..... B25F 1/04 30/154
2,010,202 A * 8/1935 Santora ..... B44D 3/164 24/265 EE
2,213,071 A * 8/1940 Keller ..... B44D 3/105 30/169
2,559,993 A * 7/1951 Parrigin et al. ..... B27G 17/00 30/161
2,759,218 A * 8/1956 Smith ..... E04F 21/32 30/293
2,839,110 A * 6/1958 Carpenter ..... B27B 25/10 7/105
2,862,296 A * 12/1958 Anderson ..... B26B 5/001 30/162
D201,710 S 7/1965 Monek
3,248,754 A * 5/1966 De Mario ..... E04F 21/32 222/105

(Continued)

FOREIGN PATENT DOCUMENTS

CH 701-714 B1 11/2013
CN 300840659 10/2008

(Continued)

*Primary Examiner* — Jason Daniel Prone
(74) *Attorney, Agent, or Firm* — McNair Law Firm, P.A.; Douglas L. Lineberry

(57) ABSTRACT

A multi-use tool with a shaped blade, a retractable tool, and handle with an angled hammering section that allows for a single user to complete varied tasks with just the one multi-use tool.

17 Claims, 4 Drawing Sheets

(56) References Cited

U.S. PATENT DOCUMENTS 3,774,252 A * 11/1973 Cantales ..... B44D 3/105 7/105
D268,085 S * 3/1983 Brunson ..... D8/45
4,536,910 A * 8/1985 Clark ..... B44D 3/105 30/169
4,768,254 A * 9/1988 Bell ..... B44D 3/164 30/172
5,008,970 A * 4/1991 Tsai ..... A47L 13/022 30/169
5,063,627 A * 11/1991 Marra ..... B44C 7/02 30/169
5,099,538 A * 3/1992 Gaconnet ..... A47L 11/12 15/236.01
D326,546 S * 5/1992 Gringer ..... D32/49
D327,553 S * 6/1992 Gringer ..... D32/49
5,220,701 A * 6/1993 Creato ..... B26B 11/001 30/152
5,251,352 A * 10/1993 Cullison ..... B25F 1/04 30/169
5,490,331 A * 2/1996 Gold ..... B26B 5/001 30/169
5,513,405 A * 5/1996 Bradbury, Jr. ..... B26B 5/00 30/123
5,546,625 A * 8/1996 Mealey, Sr. ..... B05C 21/00 30/357
D380,661 S * 7/1997 Lehmann ..... D32/46
D386,372 S * 11/1997 Weiss ..... D32/49
D399,621 S * 10/1998 Henke ..... D32/49
5,829,082 A * 11/1998 Moreira ..... B25F 1/02 7/167
D405,668 S * 2/1999 Henke ..... D8/105
5,870,786 A 2/1999 Papadopoulos
5,894,624 A * 4/1999 Fulenwider ..... A46B 7/023 15/105
5,956,788 A 9/1999 Henke
6,009,581 A 1/2000 Davis et al.
D424,390 S * 5/2000 Denton ..... D8/105
6,131,222 A * 10/2000 Anderson ..... B25F 1/003 7/105
D435,408 S 12/2000 Panfill et al.
6,272,708 B1 * 8/2001 Chen ..... B25G 1/04 30/169
D450,994 S 11/2001 Abbott
6,421,860 B1 * 7/2002 Abbott ..... B25F 1/00 7/105
6,427,274 B1 8/2002 Abbott
D462,251 S 9/2002 Collins et al.
6,453,563 B1 * 9/2002 Farland ..... B26B 3/00 30/169
6,530,098 B1 * 3/2003 Gringer ..... B25B 15/00 7/105
D475,825 S * 6/2003 Ribezzo ..... D32/49
6,640,369 B1 * 11/2003 Malvasio ..... B44D 3/006 15/105
6,662,521 B1 * 12/2003 Escobedo ..... B25B 15/00 7/105
6,668,751 B1 * 12/2003 Henke ..... B25G 1/00 116/DIG. 41
6,769,147 B1 * 8/2004 Stubbs ..... B25F 1/04 30/169
6,954,958 B2 10/2005 Stubbs
D516,394 S 3/2006 Chen
D520,827 S * 5/2006 Denton ..... D8/45
7,107,885 B2 * 9/2006 Chen ..... B25G 1/08 81/177.4
D562,517 S 2/2008 Henke et al.
7,340,836 B2 * 3/2008 Whitemiller ..... B23D 49/14 30/162
D573,863 S * 7/2008 Arvinte ..... D32/48
D580,731 S * 11/2008 Arvinte ..... D8/107
D581,764 S 12/2008 Kinskey et al.
7,647,702 B2 * 1/2010 Polei ..... B26B 5/001 30/162
D609,992 S * 2/2010 Delaney ..... D32/49
D609,993 S * 2/2010 Cain ..... D8/105
D616,719 S * 6/2010 Moore ..... D8/105
7,818,843 B2 10/2010 Kinskey et al.
8,250,764 B2 * 8/2012 Davis ..... B26B 5/001 30/162
D691,773 S 10/2013 Chen
D693,077 S * 11/2013 Thompson ..... D32/46
8,584,302 B2 * 11/2013 Stroup ..... B08B 1/008 15/235.8
8,856,995 B2 10/2014 Arvinte et al.
9,315,369 B2 * 4/2016 Wang ..... B67B 7/44 7/118
D756,735 S * 5/2016 Farland ..... D8/45
D784,100 S * 4/2017 Montgomery ..... D8/45
2002/0002754 A1 * 1/2002 Wendel ..... E04F 21/06 15/235.4
2002/0073554 A1 * 6/2002 Chen ..... B25G 1/102 30/169
2002/0170134 A1 * 11/2002 Martin ..... A47L 13/08 30/169
2006/0080840 A1 * 4/2006 Freeman ..... B26B 3/06 30/151
2007/0157472 A1 * 7/2007 Critelli ..... B26B 5/00 30/162
2010/0011526 A1 * 1/2010 Cantu ..... E04F 21/161 15/235.4
2011/0010868 A1 1/2011 Palladino
2011/0138540 A1 * 6/2011 Kinskey ..... B25F 1/00 30/165
2012/0144678 A1 * 6/2012 Chen ..... B26B 1/046 30/161
2013/0227794 A1 * 9/2013 Wang ..... B25F 1/04 7/118
2015/0246439 A1 * 9/2015 Raymond ..... B25B 15/00 7/165
2016/0221174 A1 * 8/2016 Raymond ..... B25F 1/04 7/105

FOREIGN PATENT DOCUMENTS

CN 202913624 U 5/2013
CN 202954542 U 5/2013
CN 303140874 S 3/2015
FR 2-990-371 9/2014

* cited by examiner

UTILITY PUTTY KNIFE WITH RETRACTABLE TOOL

BACKGROUND OF THE INVENTION

1) Field of the Invention

The present disclosure relates to the field of hand-held tools and more particularly to a multi-purpose tool that provides multiple work functions.

2) Description of Related Art

Various handheld tools are known in the art. U.S. Pat. No. 7,818,843 to Kinskey et al., for example, discloses a Multi-Function Tool Apparatus and System. The tool includes a butt end with a screwdriver in releasable engagement with the handle. The butt end of the tool is removable to expose a shaft and screwdriver bits, as well as to accommodate a threaded extension pole insert to allow the tool to be used in remote areas. Further, the blade is not fixed but interchangeable. However, the structure of the handle, including the threaded interior, prevent the handle from being used to strike surfaces, akin to a hammer, as doing so would likely damage the releasably engaged tool and warp or twist the internal threads.

Stubbs, U.S. Pat. No. 6,954,958, discloses a Multi-Use Broad Bladed Knife, the knife includes a broad blade attached to a handle. The heel of the handle is covered by a hard material to serve as a striking surface. The handle includes multiple slidably extendable and retractable implements, such as blades and screwdrivers. However, Stubbs discloses a single blade with a single working surface.

Arvinte, U.S. Pat. No. 8,856,995 discloses a putty knife with an elongated handle that includes a screw bit assembly located on the end of the handle. The screw bit assembly is rotatably fixed within the handle to allow the screw bit to rest within the handle and then rotate outward from the handle into a fixed, slanted position where the screw bit may then be used in a comfortable manner. However, the rotatable assembly occupies the entirety of the handle end, preventing any other tools from being stored in the handle or accessed therefrom.

Papadopoulos, U.S. Pat. No. 5,870,786, discloses a multipurpose tool including a fixed blade with a scraper edge, a concave surface, and shaped ends. The handle includes multiple, rotatably mounted screwdriver attachments that extend to form roughly a ninety degree angle with the handle. The aft end of the device includes a hammer head. However, the screwdriver attachments are not retractable into the handle. Instead, they reside within open cavities formed into the handle exterior. These cavities decrease the user's grip surface and allow materials to enter into the cavities, which may impeded removing the tools from the cavities.

CH 701 714, to Branchini, discloses a single piece, unshaped blade with both a disposable blade and a screwdriver positioned in the handle. The blade being unshaped limits it to basically scrapping functions, while the end of the device is unsuitable for being used to hammer given the presence of the screwdriver hinge. Any sufficient impacts would likely interfere with the hinge and/or introduce foreign material that may clog or negatively impact hinge, preventing the screwdriver from opening.

U.S. Pat. No. 1,597,464, to Hebner, provides a combination putty knife and tool. The blade of the Hebner device is a simple, narrow "spade" shaped blade affixed in place. The handle of the device includes a hammerhead riveted to the handle and extending laterally from the handle. A retractable screw driver is positioned within the handle. However, the extended hammerhead would serve to catch on surfaces, as well as interfere with the user's grip on the device, and would make for awkward hammering given the position of the hammerhead on the tool.

U.S. Pat. No. 960,624 discloses a putty knife with a shaped head and a solid, one-piece handle. The handle does not accommodate any tools, and is rounded, thus limiting its ability as a striking surface.

U.S. Pat. No. 825,063 discloses a tool handle with a simple fixed blade attached. A spring motivated tack puller is located within the handle. However, the lack of a shaped blade and hammering surface limit the usefulness of this device. Further, using the handle as a hammer may damage the spring motivated tack puller.

Accordingly, it is an object of the present disclosure to provide a utility putty knife with a retractable tool that overcomes the failings of the above-mentioned references.

SUMMARY OF THE INVENTION

The above objectives are accomplished according to the present invention by providing a multiuse tool. The tool includes a handle with a first end, a second end, and a body. The handle body defines an internal cavity and a retractable element is located within the internal cavity. A tool is engaged with the retractable element and may be completely contained within the internal cavity as well as extends linearly therefrom. A fixed blade is attached to the first end of the handle and defines at least one opening within the body of the fixed blade, as well as defines at least two shaped apertures along the perimeter of the fixed blade. The handle is shaped such that the second end of the handle forms an obtuse angle with respect to the body of the handle. At least one corner of the second end of the handle is reinforced to form an angled hammering point.

In a further embodiment, the fixed blade includes a spreading body. Even further, the fixed blade may include a tapered edge at the front edge of the fixed blade. In another embodiment, the fixed blade includes a crack opener. In a yet further embodiment, one aperture defined in the perimeter of the fixed blade is a curved paint roller cleaner. In yet another embodiment, the aperture defined in the perimeter of the fixed blade is a bottle opener. In another embodiment, the at least one opening in the body of the fixed blade is shaped to form a nail puller. Still further, tool engaged with the retractable element may be a utility knife blade. In a still further embodiment, the at least one corner of the second end of the handle is reinforced to form a hammering surface by placing a hardened cover over the corner, without the hardened cover extending over the remainder of the second end of the handle.

In an alternative embodiment, a combination tool is provided. The tool includes a shaped blade, a handle with a first end, a second end, and a body. The shaped blade may be attached to the first end of the handle. An engagement mechanism may be located on an exterior of the handle body and serves to extend a tool located within the handle body from the second end of the handle in a linear fashion. The shaped blade has at least one shaped cavity defined within and surrounded by the surface of the shaped blade. The shaped blade also may have at least one shaped recess formed in an edge of the shaped blade. The handle second end may form first and second corners: the first corner extending farther from the handle body than the second corner. At least the first corner of the second end of the handle body may have a reinforcement to form an angled hammering surface.

In a further embodiment, the reinforcement of the first corner covers only the first corner and does not extend over a remainder of the handle second end. In another embodiment, the engagement mechanism releases a utility blade from the second end of the handle. In a yet other embodiment, the handle is formed from a first haft part and a second haft part joined together. In another embodiment, the shaped cavity forms a nail pulling mechanism. Still further, the at least one shaped recess forms a paint roller cleaner. Even further, a second shaped recess forms a bottle opener. In a yet still further embodiment, the shaped blade has an edge section tapered on a top side of the edge section and a bottom side of the edge section to form a tapered edge. In another embodiment, the shaped blade has a front edge, wherein the front edge is tapered on only one side.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

Figure 1:
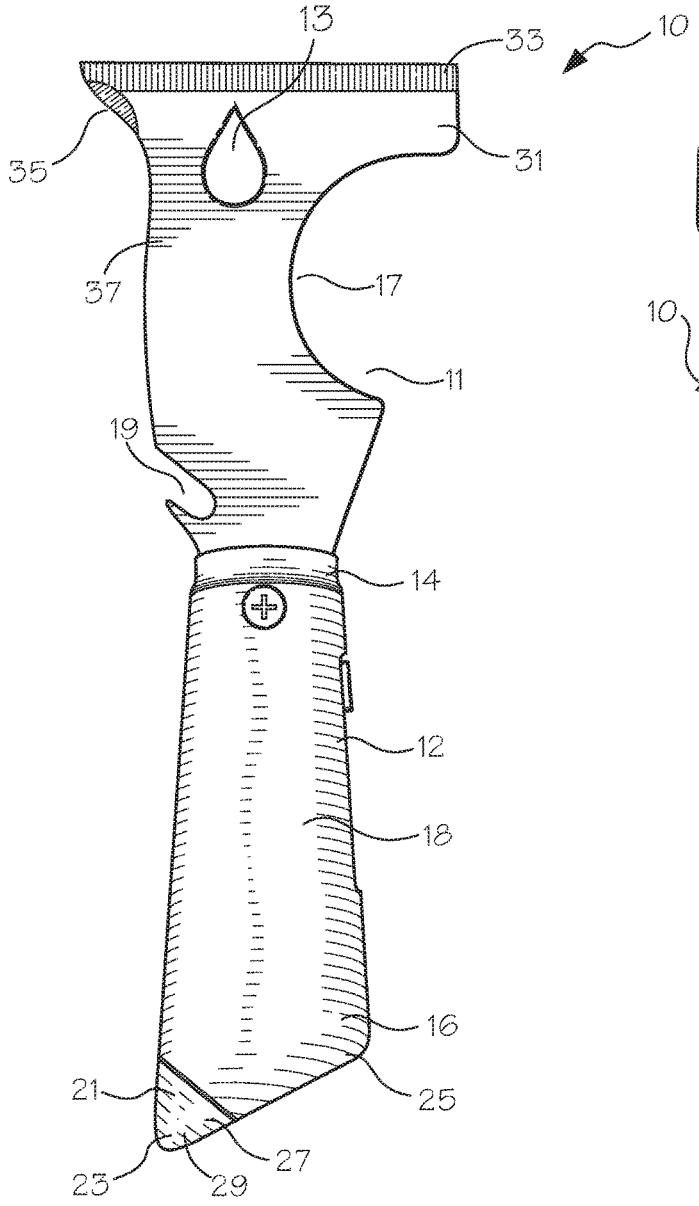
FIG. 1 shows a top view of a multi-use tool of the current disclosure.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, data, figures and all reasonable inferences to be drawn therefrom, alone or with consideration of the references incorporated herein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

Figure 2:
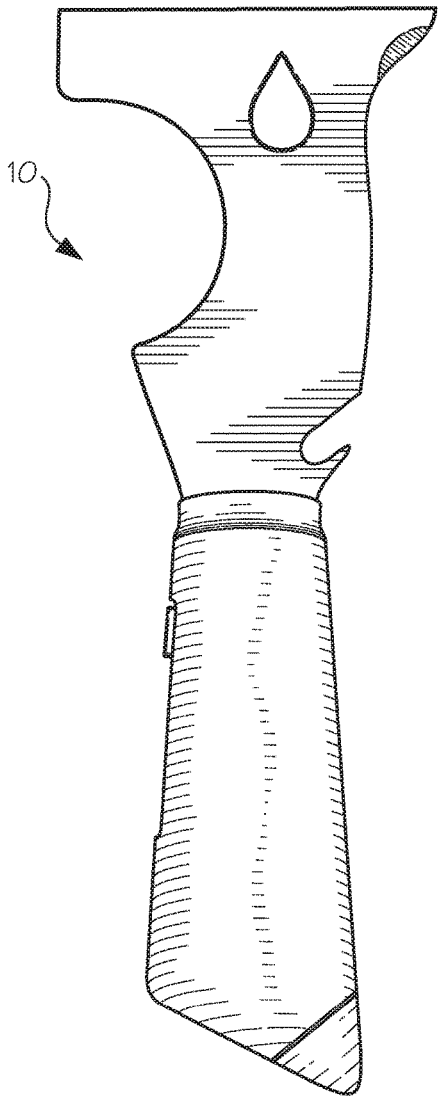
FIG. 2 shows a bottom view of a multi-use tool of the current disclosure.

FIG. 1, by way of example and not limitation, shows a top view of multi-use tool 10. FIG. 2 shows the bottom view of multi-use tool 10. Tool 10 has a handle 12, with a first end 14, a second end 16, and a body 18. Handle 12 may be constructed from any durable material including metal, plastic, wood, synthetics, etc., as known to those of skill in the art. Fixed blade 11 may be attached to handle 12. Fixed blade 11 may possess various shapes in order to allow multi-use tool 10 to be used for various jobs or tasks.

In one embodiment, multi-use tool 10 may be designed to assist painters and sheetrock installers. Fixed blade 11 may include a shaped opening 13 defined entirely within the body of fixed blade 11 and surrounded by the material forming fixed blade 11. Shaped opening 13 may have various shapes but in a preferred embodiment, it is shaped to accommodate a nail or fastener head and to secure same so that the user may leverage the nail or fastener from its position using tool 10 for leverage.

Fixed blade 11 may also include shaped apertures defined within a perimeter or edge of fixed blade 11. In one embodiment, fixed blade 11 may include a first shaped aperture 17 and a second shaped aperture 19. Shaped apertures may take any preferred shape such as curves, angles, open circles, semi-circles, open square shapes, hooks, prongs, etc., as may be defined along the perimeter of fixed blade 11. In a preferred embodiment, first shaped aperture 17 may be formed to engage a paint roller to allow the user to remove excess paint or clean the roller after use. Second shaped aperture 19, in a preferred embodiment, may be shaped to form a bottle opener by defining a hook or prong extending outward from fixed blade 11.

Handle 12 at second end 16 may be shaped to form a protrusion or obtuse angle with respect to handle body 18. It should be understood the protrusions and formation of the obtuse angle may take many shapes, forms and designs and should not be considered restrained or limited to just those displayed in the Figures herein. For instance, the protrusions could be rounded in shape, angular, curved, etc., as known to those of skill in the art. In one embodiment, second end 16 may be formed to possess an angled end 21 possessing a first corner 23 that is further from handle body 18 than second corner 25. At least a portion of angled end 21 may contain a reinforcement 27. As shown via FIG. 3, reinforcement 27 may be formed by widening or thickening one wall of the handle body 18 with respect to the opposing wall. Forming one wall of the handle body 18 wider than the opposing wall allows for reinforcement 27 to absorb impact and transfer force from the user while reducing the possibility of damaging handle body 18. Reinforcement 27 may cover substantially all of angled end 21. In a further embodiment, reinforcement 27 may be a cover overlaying only first corner 23 without extending over the remainder of the second end of the handle. Reinforcement 27 may be formed from metal, plastic, wood, synthetics, or other suitable materials as known to those of skill in the art to enable first corner 23 to act as an angled hammering point 29.

Angled hammering point 29 is an improvement over past multi-use tools in that it concentrates the hammering blunt force of the device to first corner 23. Other devices use the base of the handle, see, e.g., Papadopoulos, U.S. Pat. No. 5,870,786 that forms a protrusion on the base of the handle adjacent the hinge for its tools, or Stubbs, U.S. Pat. No. 6,954,958, that forms the hammering surface over the slots for its internal tools. These configurations place blunt force impact directly over the tools and may result in the slots, hinges, or other operating mechanisms of these devices becoming clogged, blocked, or impeded, either by deformation of the tool or by introduction of a foreign body into the tool cavity or the hinge area. The current disclosure does away with these design flaws by focusing the hammering force to one corner of the handle. Not only this, but the angled hammering point 29 provides a concise, focused point of impact, rather than simply banging the butt of the handle against the offending object. Angled hammering point 29 may be used for setting screw projections or "pops" in drywall or other typical construction activities. Angled hammering point 29 may be made from plastics, synthetics, metals, etc., as known to those of skill in the art. In one embodiment, angled hammering point 29 may be made of the same material as handle body 18. In other embodiments, angled hammering point 29 may be made of different materials from handle body 18, for instance, body 18 may be plastic or soft metal, while point 29 may be hardened steel, aircraft grade aluminum, etc.

Referring further to FIG. 1, In a further embodiment, fixed blade 11 of tool 10 may include a spreading body 31 for applying putty, pastes, sheetrock mud, etc. Spreading body 31 may be shaped to perform various functions and may be further modified to include features such bristles, not shown, for cleaning paint brushes. Spreading body 31 may also be tapered along front edge 33. The taper may be angled at fixed blade 11 and may also include a wedge or crack opener 35. Crack opener 35 may comprise a section of perimeter 37 of fixed blade 11. Crack opener 35 may be formed by tapering either a single side of fixed blade 11 or by tapering both sides of fixed blade 11 to form either a narrow wedge or sharp point for inserting into drywall or other surfaces to pry and chip away loose material in order to improve repairs.

Figure 2A:
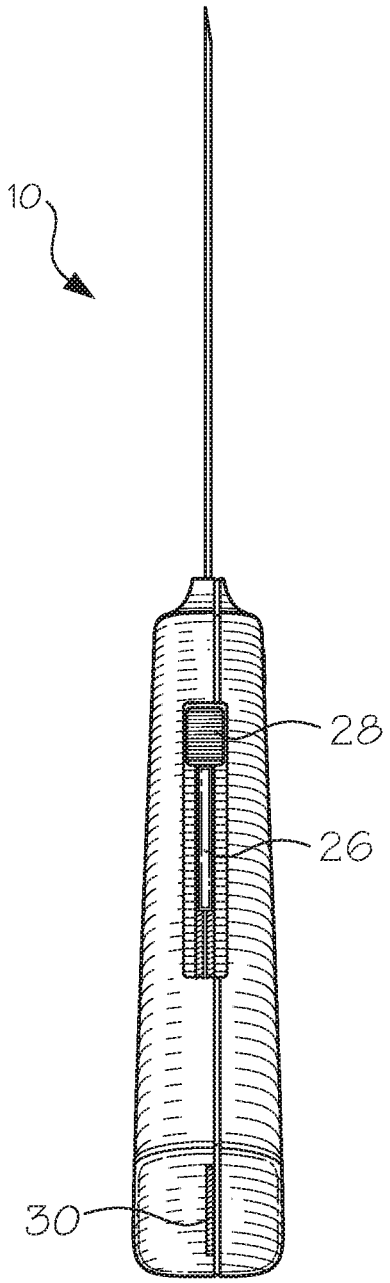
FIG. 2A shows a side view of a multi-use tool of the current disclosure.
Figure 2B:
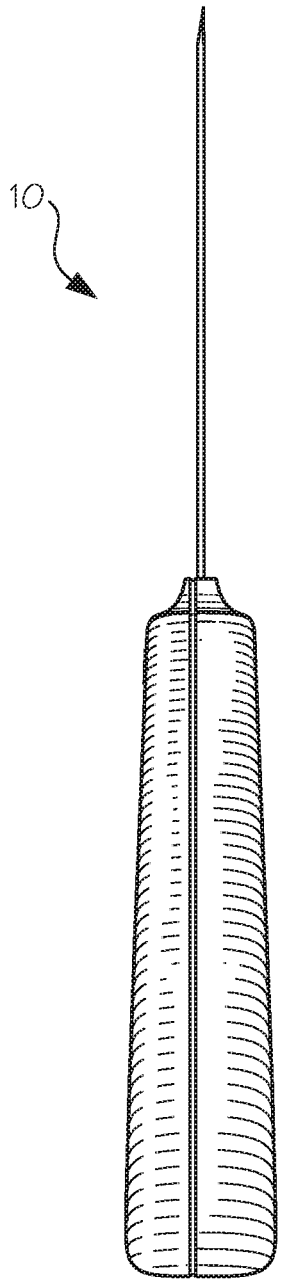
FIG. 2B shows an opposing side view of a multi-tool of the current disclosure.

FIG. 2 shows a bottom view of a multi-use tool of the current disclosure. FIG. 2A shows a side view of a multi-use tool of the current disclosure. FIG. 2B shows an opposing side view of a multi-tool of the current disclosure.

Figure 3:
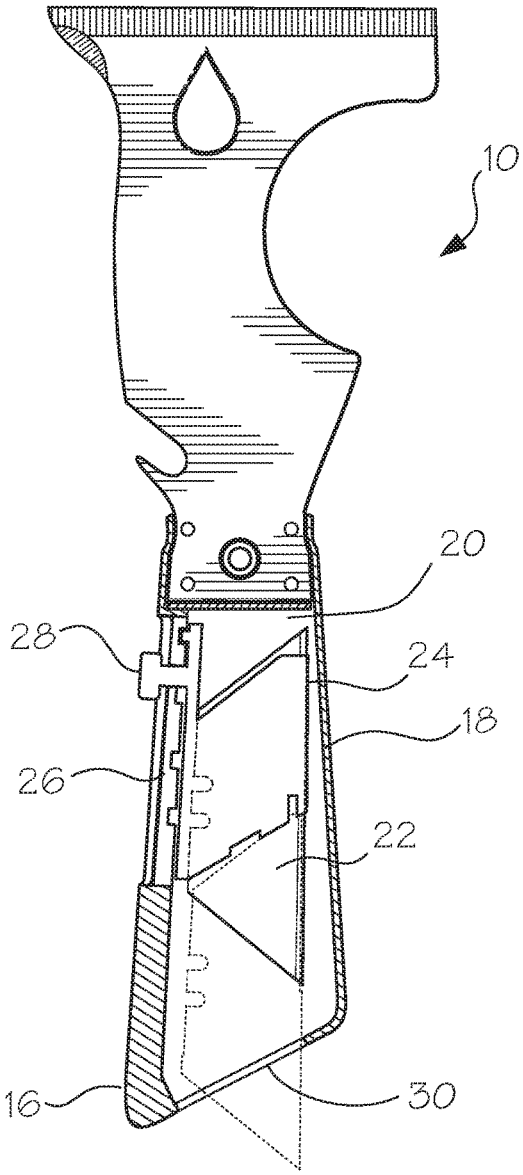
FIG. 3 shows a top, cut away view of a multi-tool of the current disclosure showing a blade in closed and open positions.

Referring now to FIG. 3, handle body 18 may define a cavity 20 disposed within the interior of handle body 18. Cavity 20 may be shaped to hold a tool 22. Tool 22 may be a blade, screwdriver, prying implement, saw blade, measuring stick, or any other tool capable of being positioned inside cavity 20 and extending linearly therefrom. Cavity 20 is designed to hold only a single type of tool, e.g., in a preferred embodiment a utility blade that may retract into and out of the handle but no tools in addition to the utility blade. Adding multiple types of tools in cavity 20 increases the cost and complexity of the device, as well as creates the possibility that the tools may interfere with one another or one tool may become damaged and prevent the user from being able to access the other tool(s).

Figure 3A:
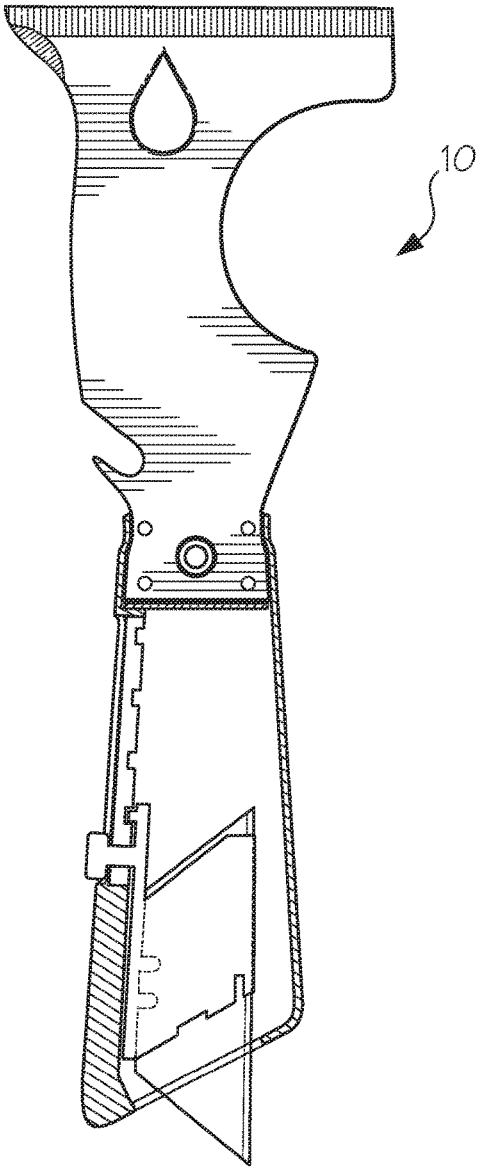
FIG. 3A shows a top, cut away view of a blade fully extended from the multi-use tool.

In a preferred embodiment, tool 22 may include a blade, such as a replaceable utility blade. In some embodiments, cavity 22 may store multiple blades along with the blade being retracted and extended. Retractable element 24 may be positioned within cavity 20. Activator 28 may be positioned in slot 26 and activate retractable element 24 by depressing activator 28. This may allow retractable element 24 to move tool 22 forward and back along a linear path within cavity 20. FIG. 3A shows a top, cut away view of a blade fully extended from the multi-use tool.

Figure 4:
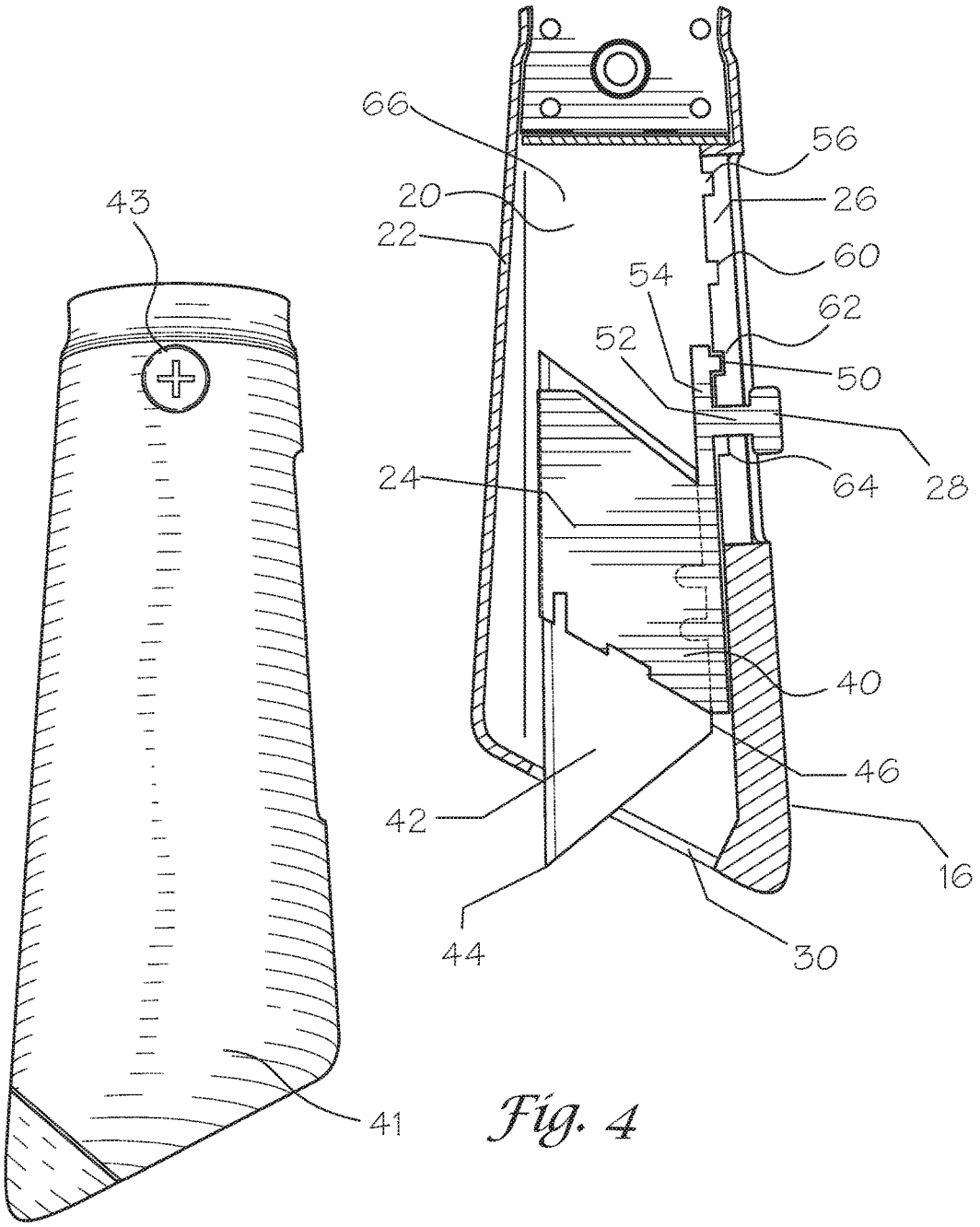
FIG. 4 shows a close-up view of one embodiment of a cutting assembly for a multi-tool of the present disclosure.

Referring to FIG. 4, a close up view of cutting assembly 40 is shown. Tool 22 is contained inside internal cavity 20 of handle 12 when retracted. With respect to FIG. 4, tool 22 is shown as utility blade 42 but other tools are considered disclosed herein. Blade 42 has sharpened point 44 and spine 46. Blade 42 attaches to a retractable element 24. Retractable element 24 may be integral with blade 42 such as by uniform construction, welding, adhesives, etc., as known to those of skill in the art. In a preferred embodiment, blade 42 may be replaceably engaged with retractable element 24 such that blade 42 may be replaced by another blade, not shown, once blade 42 becomes dull and used.

Retractable element 24 may be constructed of rigid or flexible materials, which may include metals, plastics, synthetics, etc. Retractable element 24 includes catch 50 and stem 52. Stem 52 extends from arm 54 of retractable element 24 and ends at activator 28. When activator 28 is activated, such as by depressing activator 28 or removing it from a catch element, not shown, stem 52 forces arm 54 downwards. When arm 54 is forced downwards, catch 50 travels downward as well. Catch 50 may engage a first recess 56 integral to handle body 18.

When catch 50 is positioned at first recess 56, blade 42 is completely retracted and completely contained within handle body 18. When catch 50 is engaged with first recess 56 and activator 28 is depressed, catch 50 moves out of first recess 56 and may slide along slot 26 toward handle second end 16. As retractable element 24 moves in slot 26, catch 50 may engage second recess 60, third recess 62 or fourth recess 64. As catch 50 engages the recesses, retractable element 24 moves blade 42 closer to, and eventually through, second end 16 of handle body 18 via opening 30. As catch 50 engages successive recesses moving toward second end 16, more of blade 42 becomes exposed through opening 30. Although four recesses are shown, with the fourth recess 64 having blade 42 fully extended, more or less recesses are within the disclosure of this embodiment. In one embodiment, there may only be a first recess 56 and a last recess 64, omitting recess between the two points so that blade 42 moves from a fully closed to fully open position in one movement. Conversely, more recesses may be added to allow the user to have fine control over how much of blade 42 extends through opening 30. Groove 66, within internal cavity 20, positions retractable element 48 as it slides within internal cavity 20.

In a further embodiment handle 12 may be formed as a single piece or may be formed from multiple pieces. In one embodiment, handle 12 includes a cover 41 that may be removed to expose cutting assembly 40. This may allow for replacing blade 42 or accessing the interior of handle 12. Cover 41 may be held in place by a fastener or coupler 43. This may include, but is not limited to, a screw, bolt, screw and nut combination, frictional engagement, etc., as known to those of skill in the art.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. A multi-use tool comprising:

a handle with a first end, a second end defining an opening, a first wall, and an opposed second wall wider than the first wall, the walls connecting the first and second ends, the walls and ends defining an internal cavity in communication with the opening;

the handle defining a longitudinal axis and the second end of the handle forms an obtuse angle with respect to the longitudinal axis;

the wider second wall and the second end define a reinforced angled hammering point corner;

a retractable element located within the internal cavity;

a tool engaged with the retractable element wherein movement of the retractable element causes the tool to completely retract into and extend from the internal cavity via the opening;

a fixed blade attached to the first end of the handle; and the fixed blade having a body, at least one opening within the body of the blade, and at least two apertures along a perimeter of the body of the blade.

2. The multiuse tool of claim 1, wherein the body of the fixed blade includes a spreading surface.

3. The multiuse tool of claim 1, wherein the body of the fixed blade includes a tapered edge at a front of the fixed blade.

4. The multiuse tool of claim 1, wherein the body of the fixed blade includes a crack opener.

5. The multiuse tool of claim 1, wherein one of the apertures defined in the perimeter of the body of the fixed blade is a curved paint roller cleaner.

6. The multiuse tool of claim 1, wherein one of the apertures defined in the perimeter of the body of the fixed blade is a bottle opener.

7. The multiuse tool of claim 1, wherein the at least one opening in the body of the fixed blade is shaped to form a nail puller.

8. The multiuse tool of claim 1, wherein the tool engaged with the retractable element is a utility knife blade.

9. The multi-use tool of claim 1, wherein the reinforced angled hammering point corner incorporates a hardened cover without the hardened cover extending over a remainder of the second end of the handle.

10. A combination tool comprising:

a shaped blade;

a handle with a first end, a second end, a first wall, and an opposed second wall wider than the first wall, the walls connecting the first and second ends, the walls and ends defining an internal cavity;

the shaped blade is attached to the first end of the handle;

the second end of the handle defining a first corner with the first wall and the second end of the handle defining a second reinforced angled hammering point corner with the second wider wall, the second reinforced angled hammering point corner extending farther from the shaped blade than the first corner;

an engagement mechanism movably connected to the second wall and being in communication with the internal cavity; and the shaped blade having a surface, at least one shaped cavity within and surrounded by the surface of the blade, and at least one shaped recess in an edge of the surface of the blade.

11. The combination tool of claim 10, a utility blade engaged with the engagement mechanism in the internal cavity.

12. The combination tool of claim 10, wherein the handle is formed from a first half part and a second half part joined together and the half parts define the first end, the second end, the first wall, and the second wider wall.

13. The combination tool of claim 10, wherein the at least one shaped cavity forms a nail pulling mechanism.

14. The combination tool of claim 10, wherein the at least one shaped recess forms a paint roller cleaner.

15. The combination tool of claim 10, wherein the at least one shaped recess forms a bottle opener.

16. The combination tool of claim 10, wherein the surface of the shaped blade has an edge section tapered on a top side of the edge section and a bottom side of the edge section to form a tapered edge.

17. The combination tool of claim 10, wherein the surface of the shaped blade has a front edge, wherein the front edge is tapered on only one side.

* * * * *